US011230109B2

(12) United States Patent
Thomas et al.

(10) Patent No.: US 11,230,109 B2
(45) Date of Patent: Jan. 25, 2022

(54) PIGMENT DISPERSAL IN AN INK JET PRINTER

(71) Applicant: LINX PRINTING TECHNOLOGIES LTD, St Ives (GB)

(72) Inventors: Graham Thomas, St Ives (GB); Bryn Jones, St Ives (GB)

(73) Assignee: LINX PRINTING TECHNOLOGIES LTD, St Ives (GB)

( * ) Notice: Subject to any disclaimer, the term of this patent is extended or adjusted under 35 U.S.C. 154(b) by 14 days.

(21) Appl. No.: 16/646,677

(22) PCT Filed: Sep. 19, 2018

(86) PCT No.: PCT/GB2018/052677
§ 371 (c)(1),
(2) Date: Mar. 12, 2020

(87) PCT Pub. No.: WO2019/063978
PCT Pub. Date: Apr. 4, 2019

(65) Prior Publication Data

US 2020/0276823 A1 Sep. 3, 2020

(30) Foreign Application Priority Data

Sep. 26, 2017 (GB) ..... 1715541

(51) Int. Cl.
*B41J 2/175* (2006.01)
*B41J 2/17* (2006.01)
*B41J 2/185* (2006.01)

(52) U.S. Cl.
CPC ..... *B41J 2/17513* (2013.01); *B41J 2/1707* (2013.01); *B41J 2/17523* (2013.01); *B41J 2/17596* (2013.01); *B41J 2/185* (2013.01)

(58) Field of Classification Search
CPC .. B41J 2/17513; B41J 2/1707; B41J 2/17596; B41J 2/17523; B41J 2/185
(Continued)

(56) References Cited

U.S. PATENT DOCUMENTS 4,658,268 A 4/1987 Needham
5,451,987 A 9/1995 Perrin
(Continued)

FOREIGN PATENT DOCUMENTS

EP 1083054 3/2001
EP 2193924 6/2010
(Continued)

OTHER PUBLICATIONS

PCT Application No. PCT/GB/2018/052677, International Search Report dated May 12, 2018.
(Continued)

*Primary Examiner* — An H Do
(74) *Attorney, Agent, or Firm* — Lathrop GPM LLP

(57) ABSTRACT

In a continuous ink jet printer for use with pigmented ink, the entrance to the ink path (81), (35) from the interior of the ink tank (27) to the ink pump (31) is made up of a plurality of small inlet openings, which may be provided by nozzles 85 formed in a shroud 83 that fits around an ink filter (33) in the ink tank (27). The openings are provided at the bottom of the ink tank (27), close to the floor, and face parallel to the floor or at least partially towards it. If the ink pump (31) is driven in reverse, any ink in the ink path is driven at speed out through the inlet openings into the interior of the ink tank (27), followed by air. This tends to disperse pigment that may have settled to the bottom on the ink tank (27).

20 Claims, 9 Drawing Sheets

(58) Field of Classification Search
USPC ..... 347/84, 85, 89
See application file for complete search history.

(56) References Cited

U.S. PATENT DOCUMENTS

| | | | |
|---|---|---|---|
| 6,231,174 | B1 | 5/2001 | Haigo |
| 6,428,156 | B1 | 8/2002 | Waller et al. |
| 2012/0194619 | A1 | 8/2012 | Smith et al. |
| 2012/0224007 | A1 | 9/2012 | Kaoru et al. |
| 2013/0127958 | A1 | 5/2013 | Plummer |
| 2013/0286062 | A1 | 10/2013 | Cyman, Jr. et al. |
| 2014/0015905 | A1 | 1/2014 | Esdaile-Watts et al. |
| 2016/0288522 | A1 | 10/2016 | Pourtier et al. |

FOREIGN PATENT DOCUMENTS

| | | | | |
|---|---|---|---|---|
| EP | 2588323 | B1 * | 3/2015 | ..... B41J 2/18 |
| EP | 2998123 | | 3/2016 | |
| EP | 3181362 | | 6/2017 | |
| WO | 2015187839 | | 12/2015 | |

OTHER PUBLICATIONS

PCT Application No. PCT/GB/2018/052677, International Preliminary Report on Patentability, dated Mar. 31, 2020.
GB Application No. 1715541.7, Search Report dated Mar. 20, 2018, 1 page.
GB Application No. 1715541.7, Search Report dated Jun. 7, 2019, 1 page.

* cited by examiner

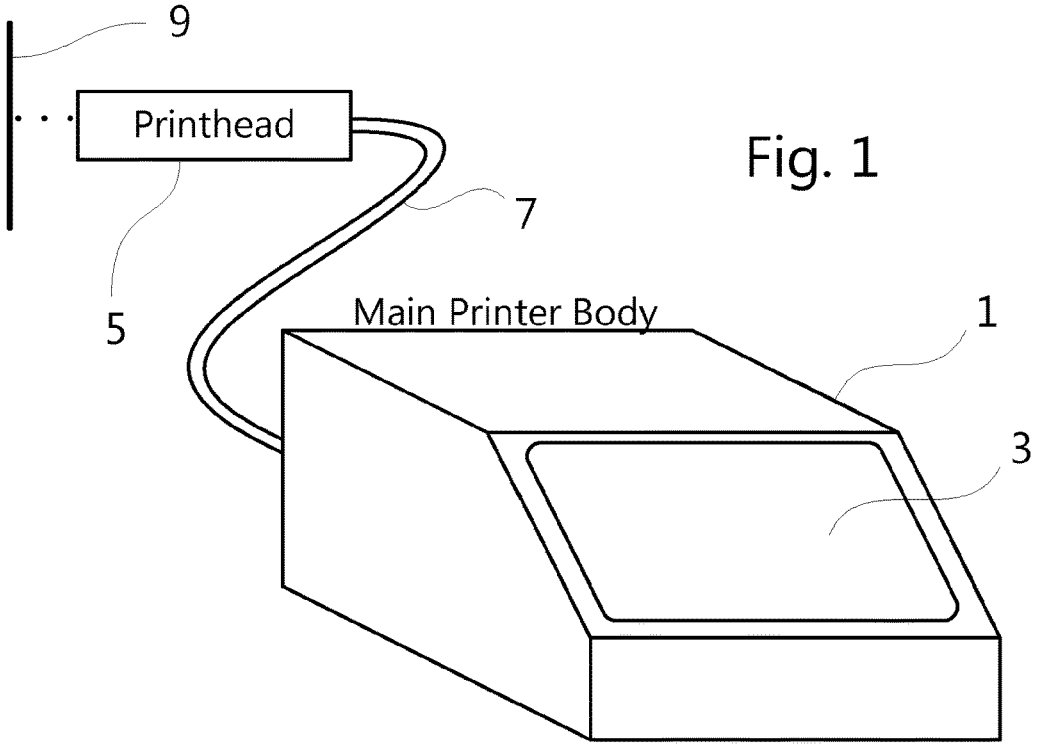
Fig. 1
Fig. 2
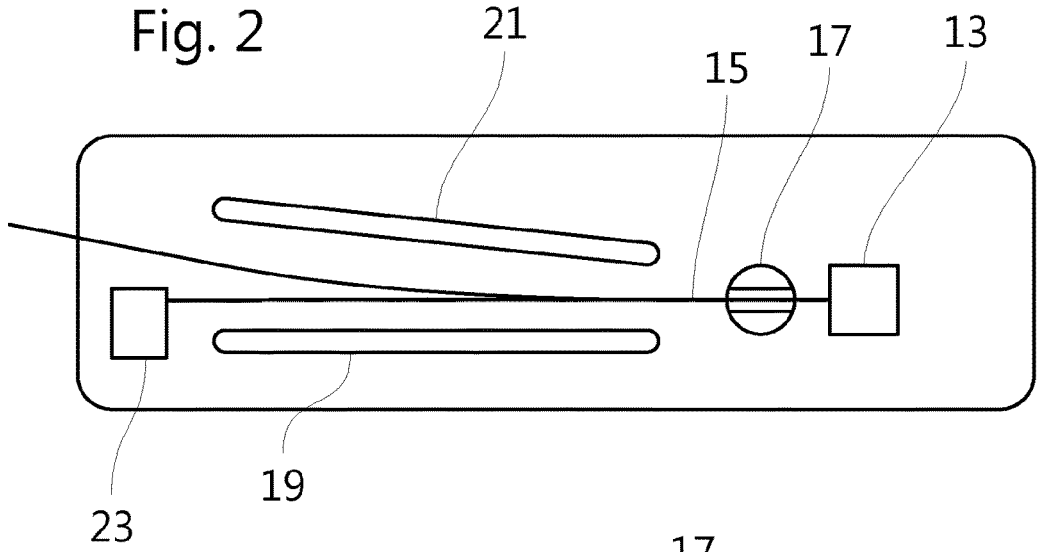
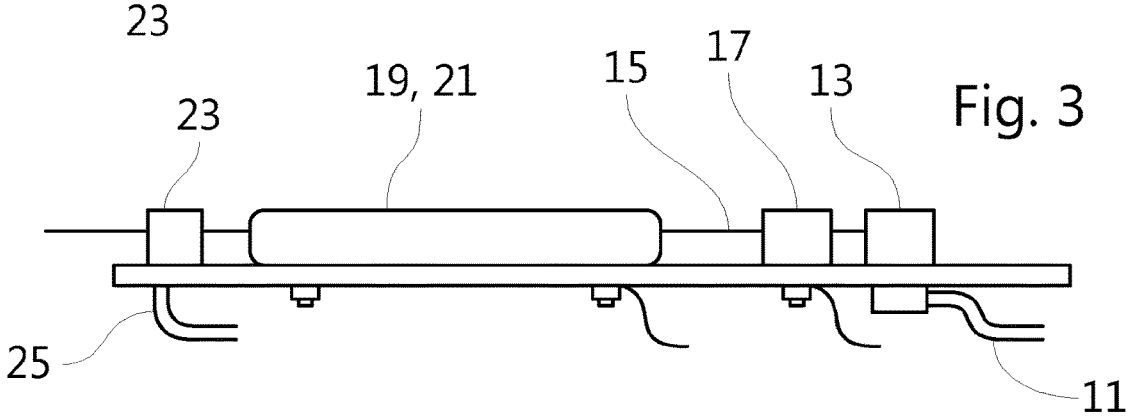
Fig. 3

PIGMENT DISPERSAL IN AN INK JET PRINTER

FIELD OF THE INVENTION

The present invention relates to a continuous ink jet printer, for example an electrostatic deflection type continuous ink jet printer.

In the operation of a continuous ink jet printer, a continuous jet of ink drops is formed. Usually, the drops are deflected in flight so that only some drops are used for printing. Drops of ink that are not required for printing are caught by a gutter and are returned to an ink tank within the main body of the printer. In an electrostatic deflection ink jet printer, this deflection is performed by trapping electric charges on some or all of the drops of ink, and using an electrostatic field to deflect the charged drops so that the printer prints the desired printed pattern.

BACKGROUND

The ink includes a colourant. In most cases the colourant is a dye, or a mixture of dyes, that are dissolved in the solvent. However, in some cases (typically when it is desired to print a pale colour such as white or yellow) the colourant comprises a pigment suspended in the ink, either with or without a dye. In use, the pigment may tend to settle out of the ink, especially if the printer is not used for an extended period. If an excessive amount of the pigment is allowed to settle out of the ink, the ink becomes less opaque and the print quality of the printer output is reduced unless the settled pigment is mixed back into the ink.

Various arrangements are known for preventing pigment from settling out of the ink or for mixing pigment back into the ink after it has settled out. For example, the ink tank may be provided with a mechanical stirrer, which can be magnetically coupled to a drive system outside the ink tank, as disclosed for example in EP 1083054 and U.S. Pat. No. 5,451,987. An alternative approach is disclosed in EP 2998123, in which the ink tank has a conical funnel-shaped bottom so that any pigment that settled out of the ink tends to gather at the lowest part of the cone. An ink outlet is provided at the bottom of the cone and a pump draws out ink, together with any pigment that has settled out, and returns it to the top of the ink tank.

This mixes back in any pigment that has settled to the bottom of the ink tank. The pump may run continuously, and may run even when the printer is not in use.

SUMMARY OF THE INVENTION

An aspect of the present invention provides an ink system for a continuous ink jet printer, the ink system comprising an ink tank, a reversible ink drive arrangement, an ink flow path having an inlet inside the ink tank and extending from the inlet to an inlet of the reversible ink drive arrangement, and an ink return path extending from an outlet of the reversible ink drive arrangement to the interior of the ink tank, whereby the reversible ink drive arrangement is operable in a forward mode to withdraw ink from the ink tank via the inlet of the ink flow path and cause it to flow along the ink flow path, through the reversible ink drive arrangement and along the ink return path back to the ink tank and whereby the reversible ink drive arrangement is operable in a reverse mode to withdraw fluid from the interior of the ink tank and cause any ink already in the ink return path or the ink flow path to flow into the ink tank via the inlet of the ink flow path.

The fluid withdrawn from the ink tank in the reverse mode is not necessarily ink, and may be air, even if ink is present at the inlet of the ink flow path, since the ink return path preferably opens into the ink tank at a position higher than the inlet of the ink flow path.

Preferably the reversible ink drive arrangement comprises a reversible pump. However, other arrangements are possible. For example, a switchover valve can be used to connect the ink flow path to the inlet of a pump and the ink return path to the outlet of the pump in the forward mode, and to connect the ink flow path to the outlet of the pump and the ink return path to the inlet of the pump in the reverse mode, so that the pump itself does not have to operate in reverse.

An aspect of the present invention provides a continuous ink jet printer having an ink gun, an ink circuit including an ink tank for holding a supply of ink to be driven out of the ink gun and an ink pump for circulating ink from the ink tank around the ink circuit and back to the ink tank, and a gutter for collecting ink that has been driven out of the ink gun and has not been used for printing and returning the ink to the ink tank, the ink circuit comprising an ink supply path for supplying ink from the ink tank to the ink pump and the ink supply path starting at one or more ink entrance openings at the bottom of the ink tank, the ink entrance openings facing at least partially towards the floor of the ink tank or facing parallel to the floor of the ink tank, and the ink pump being operable to drive fluid around the ink circuit in a reverse direction such that fluid flows from the ink pump along the ink supply path and out through the ink entrance openings. Preferably the ink supply path has a portion that extends from the one or more ink entrance openings within the ink tank and reaches a point higher than the one or more ink entrance openings. The ink supply path may exit the ink tank through the top or a side of the ink tank.

Preferably there are a plurality of ink entrance openings, more preferably at least four ink entrance openings, spaced from each other across the bottom of the ink tank. Preferably the ink entrance openings face at least partially along the floor of the ink tank.

In the case that the ink supply path includes an ink filter inside the ink tank, the ink entrance openings may be provided in a wall that surrounds the ink filter.

Preferably the linear flow rate of ink through at least some of the ink entrance openings is at least 0.1 $ms^{-1}$ during operation in the reverse mode or direction and/or during an operation to drive ink in through the inlet or ink entrance opening and forward round the ink circuit without forming an ink jet.

If there is an operation to drive ink in through the inlet or ink entrance opening and forward round the ink circuit without forming an ink jet, it is desired that the ink pump or drive arrangement is arranged or controlled to drive the ink during this operation at a volume flow rate that is at least one and a quarter times the volume flow rate of the ink pump or drive arrangement while the ink jet is formed.

It is anticipated that the total cross-sectional area of all of the ink entrance openings will normally not exceed 100 $mm^2$. It is also anticipated that the ink entrance openings will be no more than 5 mm above the floor of the ink tank. In principle, a larger total cross-sectional area and/or a greater distance above the floor may be possible, but in such cases the fluid flow velocity out of the ink entrance openings during reverse flow may have to be inconveniently high in order to be effective to disturb pigment that has settled on the floor of the ink tank.

Preferably the ink tank has a flat floor over substantially all of its entire width and breadth, in contrast to an inclined tapered (e.g. conical) floor as is known in some designs of printer for use with pigmented ink. The use of a flat floor can enable a better use of space within the printer, and may also allow the ink tank to be cheaper to manufacture.

Preferably the ink pump is reversible. However, other arrangements may enable the ink pump to be operable to drive fluid around the ink circuit in the reverse direction. For example, there may be an arrangement of one or more valves to redirect the flow of fluid from the ink pump.

An aspect of the present invention provides a method of operating a continuous ink jet printer, the printer having an ink gun for forming an ink jet, and an ink circuit comprising an ink tank for holding ink to be supplied to the ink gun, and an ink pump arrangement for pumping ink from the ink tank around the ink circuit and back to the ink tank, an ink supply path extending from one or more inlet openings inside the ink tank to an inlet of the ink pump arrangement, and an ink return path extending from an outlet of the ink pump arrangement to the interior of the ink tank, and the printer further having an ink feed path extending from the ink return path to the ink gun to supply ink, that has been pressurised by the ink pump arrangement, to the ink gun, the method comprising (a) a jet forming operation in which the ink pumping arrangement operates in a forward direction to drive ink from the ink tank along the ink supply path, through the ink pump arrangement and along the ink return path back to the ink tank and in which ink pressurised by the ink pump flows from the ink return path along the ink feed path to the ink gun and (b) an ink mixing operation that comprises a reverse flow step of operating the ink pump arrangement in a reverse direction to drive fluid from the ink tank along the ink return path to the ink pump arrangement and then along the ink supply path from the ink pump arrangement to the ink tank and out through the one or more inlet openings. If the ink circuit contains ink at the start of the reverse flow step, the ink will tend to be forced out through the one or more inlet openings. This can create a movement of ink inside the ink tank that tends to disturb ink pigment that may have settled out of the ink in the ink tank.

Preferably the ink mixing operation also comprises a forward flow step of operating the ink pump arrangement in a forward direction to drive ink from the ink tank along the ink supply path, through the ink pump arrangement and along the ink return path back to the ink tank, preferably without any ink flow along the ink feed line to the ink gun, the forward flow step being performed before the reverse flow step. Preferably the forward flow step is performed for long enough to fill the ink supply path and the ink return path with ink before the reverse flow step is carried out.

The fluid that is driven out of the ink tank in the reverse flow step may be a gas, usually air, that is in the ink tank above the ink. Preferably, in cases where the fluid is a gas and the forward flow step is carried out before the reverse flow step, the reverse flow step is carried out for long enough to drive all of the ink in the ink return path and the ink supply path out through the one of more inlet openings and is continued so as to drive gas out through the one or more inlet openings.

Alternatively, the fluid that is driven out of the ink tank in the reverse flow step may be ink. E.g. the ink return path may have an opening below the normal ink surface level in the ink tank.

Additionally, if the forward flow step is carried out, the ink may exit the ink return path through an opening in the ink tank that is below the normal ink surface level, and is preferably at the bottom of the ink tank, as this can further help to disturb pigment that has settled on the floor of the ink tank.

Preferably, ink from the ink jet that is not used for printing is returned to the ink tank in the jet forming operation. In this case, air may also be delivered to the ink tank together with the ink that is returned from the ink jet. Preferably such ink and air are delivered to a location in the ink tank above the normal ink surface level, as this minimises the tendency of air bubbles to be retained in the ink during jet forming operation. In some designs of printer, this ink and air may be delivered to the ink tank along a part of the ink return line, in which case the ink return line preferably has an opening in the ink tank that is above the normal ink surface level. If the ink return line also has an opening in the ink tank below the normal ink surface level, as described above, the ink return line may be branched and there may be one or more valves to select which opening of the ink return line is used.

Preferably the ink mixing operation comprises one or more mix cycles, each mix cycle comprising a forward flow step followed by a reverse flow step. The ink mixing operation may be carried out after a period when the printer has been idle (wherein "idle" means that the ink pump arrangement has not been operated) and before a jet forming operation. In this case, the number of mix cycles carried out before the jet forming operation may be determined, at least in part, by the length of time for which the printer has been idle.

Preferably the linear flow rate of ink through at least some of the inlet openings is at least 0.1 $ms^{-1}$ during the reverse flow step and/or during the forward flow step of the ink mixing operation (if present), and is more preferably at least 0.3 $ms^{-1}$.

If the ink mixing operation comprises a forward flow step, it is desired that the volume flow rate of ink through the ink pump arrangement during at least a part of the forward flow step is at least one and a quarter times the maximum volume flow rate of the ink pump arrangement while the ink jet is formed.

Both the flow of ink in the forward flow step and the flow of fluid in the reverse flow step tend to disturb settled pigment on the floor of the ink tank in the region of each inlet opening. Preferably there are a plurality of inlet openings, spaced apart from each other across the ink tank (spaced in one or more directions parallel to the floor of the ink tank). This will tend to increase the total area of the floor over which settled pigment is disturbed. Preferably there are at least four inlet openings. This increases the amount of settled pigment that is disturbed, thereby increasing the opacity of the ink.

The reverse flow of fluid through the ink inlet(s) is useful to disturb pigment that has settled on the floor of the ink tank. However, there may be circumstances in which it is not convenient to use reverse flow, either because it is difficult or expensive to provide a pump arrangement for reverse flow or because of some effect that reverse flow has in the ink tank. In these cases, it may be possible to disturb the pigment using forward flow alone.

A further aspect of the invention provides a continuous ink jet printer comprising an ink circuit, the ink circuit comprising an ink tank, an ink pump arrangement, an ink supply path having at least four ink inlet openings inside the ink tank and spaced from each other in one or more directions parallel to a floor of the ink tank, the ink supply path extending from the ink inlet openings to the ink pump arrangement, and an ink return path from the ink pump arrangement to the interior of the ink tank, the printer further comprising an ink gun, an ink feed path from the ink return line to the ink gun, and a control system, the control system being arranged to control the printer to operate (a) in a jet forming mode in which the ink pump arrangement pumps ink around the ink circuit in a forward direction, in which the ink flows from the interior of the ink tank through the said inlet openings and along the ink supply path to the ink pump arrangement, and from the ink pump arrangement along the ink return path back to the interior of the ink tank, and ink is allowed to flow along the ink feed path to the ink gun and out though the ink gun to form an ink jet, and (b) in an ink mixing mode in which the ink pump arrangement pumps fluid around the ink circuit in the forward direction while ink is not allowed to flow out through the ink gun to form an ink jet.

Preferably the control system is arranged to control the ink pump arrangement to pump ink in the forward direction at a first volume flow rate or at a volume flow rate within a predetermined range of first volume flow rates in the jet forming mode while the ink is allowed to flow out through the ink gun to form an ink jet, and the control system is arranged to control the ink pump arrangement to pump ink in the forward direction at a second volume flow rate for at least a part of the time that ink is not allowed to flow out through the ink gun to form an ink jet in the ink mixing mode, the second volume flow rate being at least 1¼ times the first volume flow rate or the greatest volume flow rate within the predetermined range of first volume flow rates.

Preferably the size and number of the ink inlet openings is such that operation of the ink pump arrangement to pump ink at the second volume flow rate while ink is not allowed to flow out through the ink gun to form an ink jet results in a linear flow rate of ink through each of at least four ink inlet openings of at least 0.1 $ms^{-1}$.

A further aspect of the present invention provides a method of operating a continuous ink jet printer, the printer comprising an ink circuit, the ink circuit comprising an ink tank, an ink pump arrangement, an ink supply path having at least four ink inlet openings inside the ink tank and spaced from each other in one or more directions parallel to a floor of the ink tank, the ink supply path extending from the ink inlet openings to the ink pump arrangement, and an ink return path from the ink pump arrangement to the interior of the ink tank, the method comprising: (a) a jet forming operation comprising a forward flow step in which the ink pump arrangement is used to pump ink around the ink circuit in a forward direction such that ink flows from the interior of the ink tank through the one or more inlet openings and along the ink supply path to the ink pump arrangement, and from the ink pump arrangement along the ink return path back to the interior of the ink tank; the jet forming operation further comprising conveying ink from the ink return path to an ink gun of the continuous ink jet printer to form an ink jet during the forward flow step, and (b) an ink mixing operation comprising a forward flow step in which the ink pump arrangement is used to pump fluid around the ink circuit in the forward direction without conveying ink from the ink return path to the ink gun.

Preferably the linear flow rate of ink through each of at least four ink inlet openings is at least 0.1 $ms^{-1}$ during at least a part of the forward flow step of the ink mixing operation.

A linear flow rate below 0.1 $ms^{-1}$ is likely to be less effective at disturbing pigment that has settled on the floor of the ink tank. It is preferred that the linear flow rate is at least 0.2 $ms^{-1}$ and more preferably at least 0.3 $ms^{-1}$. The linear flow rate may be up to 0.6 $ms^{-1}$ or may even be more than 0.6 $ms^{-1}$, especially in cases where reverse flow through the ink inlet openings is not used.

Preferably the ink pump arrangement pumps ink in the forward direction at a first volume flow rate or at a volume flow rate within a predetermined range of first volume flow rates while the ink jet is formed in the jet-forming operation, and the ink pump arrangement pumps ink in the forward direction at a second volume flow rate for at least a part of the forward flow step of the ink mixing operation, the second volume flow rate being at least 1¼ times the first volume flow rate or the greatest volume flow rate within the predetermined range of first volume flow rates.

The second flow rate may be higher than 1¼ times the first volume flow rate or the greatest volume flow rate within the predetermined range of first volume flow rates. For example, it may be 1½% to 2 times the first volume flow rate or the greatest volume flow rate within the predetermined range of first volume flow rates. The second flow rate may be up to 2½% times, or may even be more than 2½% times, the first volume flow rate or the greatest volume flow rate within the predetermined range of first volume flow rates.

If the second volume flow rate is greater than the first volume flow rate, or any of the first volume flow rates, the disturbance it causes in the ink in the ink tank is more effective at dislodging pigment that has settled on the floor of the ink tank. In principle, the volume flow rate could also be high while the ink jet is running, but a high volume flow rate at the ink pump arrangement tends to imply a high ink pressure in the ink return path, and it is often necessary to control the ink pressure at the ink gun in order to ensure that the ink jet is formed properly. Therefore it is normal to control the volume flow rate at the ink pump arrangement while the ink jet is running so as to provide the correct ink pressure at the ink gun. It is possible to provide a lower ink pressure at the ink gun than in the ink return path by the use of a pressure regulator, but this adds to the cost and complexity of the system.

In some designs of ink tank it may be the case that four ink inlet openings will not be adequate to disturb settled pigment over the majority of the area of the floor of the ink tank, and for this reason there are preferably at least eight ink inlet openings. Greater numbers of ink inlet openings will provide a better coverage of the floor of the ink tank and therefore there are preferably from twelve to twenty (e.g. sixteen) ink inlet openings. Although the coverage over the floor of the ink tank is improved as the number of ink inlet openings is increased, it becomes difficult to maintain an adequate flow rate through each individual opening if there are too many of them. For this reason, it is preferred that there are no more than twenty four ink inlet openings.

According to an aspect of the invention, in a continuous ink jet printer for use with pigmented ink, the entrance to the ink path from the interior of the ink tank to the ink pump is made up of a plurality of small inlet openings, which may be provided by nozzles formed in a shroud that fits around an ink filter in the ink tank. The openings are provided at the bottom of the ink tank, close to the floor, and face parallel to the floor or at least partially towards it. If the ink pump is driven in reverse, any ink in the ink path is driven at speed out through the inlet openings into the interior of the ink tank, followed by air. This tends to disperse pigment that may have settled to the bottom on the ink tank.

Further aspects of the present invention and optional features are set out in the claims.

In a printing operation of the continuous ink jet printer, a continuous jet of ink drops is formed. Usually, the drops are deflected in flight so that only some drops are used for printing. Drops of ink that are not required for printing are caught by a gutter and are normally returned to an ink tank within the main body of the printer. Preferably the continuous ink jet printer is an electrostatic deflection ink jet printer in which the deflection of ink drops is performed by trapping electric charges on some or all of the drops of ink, and using an electrostatic field to deflect the charged drops. Typically the ink includes a solvent which is normally highly volatile so that the drops of ink dry quickly after printing. The solvent also tends to evaporate from the ink that is caught in the gutter and returned to the ink tank, so that the ink used by the printer loses solvent over time. In order to maintain the correct ink viscosity, additional solvent may be added from time to time. Additionally, the ink is slowly used up as the printer prints and therefore the ink in the ink tank may also be replenished from time to time.

Embodiments of the invention, given by way of non-limiting example, will now be described with reference to the accompanying drawings, in which:

BRIEF DESCRIPTION OF THE DRAWINGS

FIG. 1 shows an ink jet printer embodying the present invention;

FIG. 2 is a schematic plan view of the print head of the printer of FIG. 1;

FIG. 3 is a schematic side view of the print head of the printer of FIG. 1;

DETAILED DESCRIPTION OF EMBODIMENTS

Figure 4:
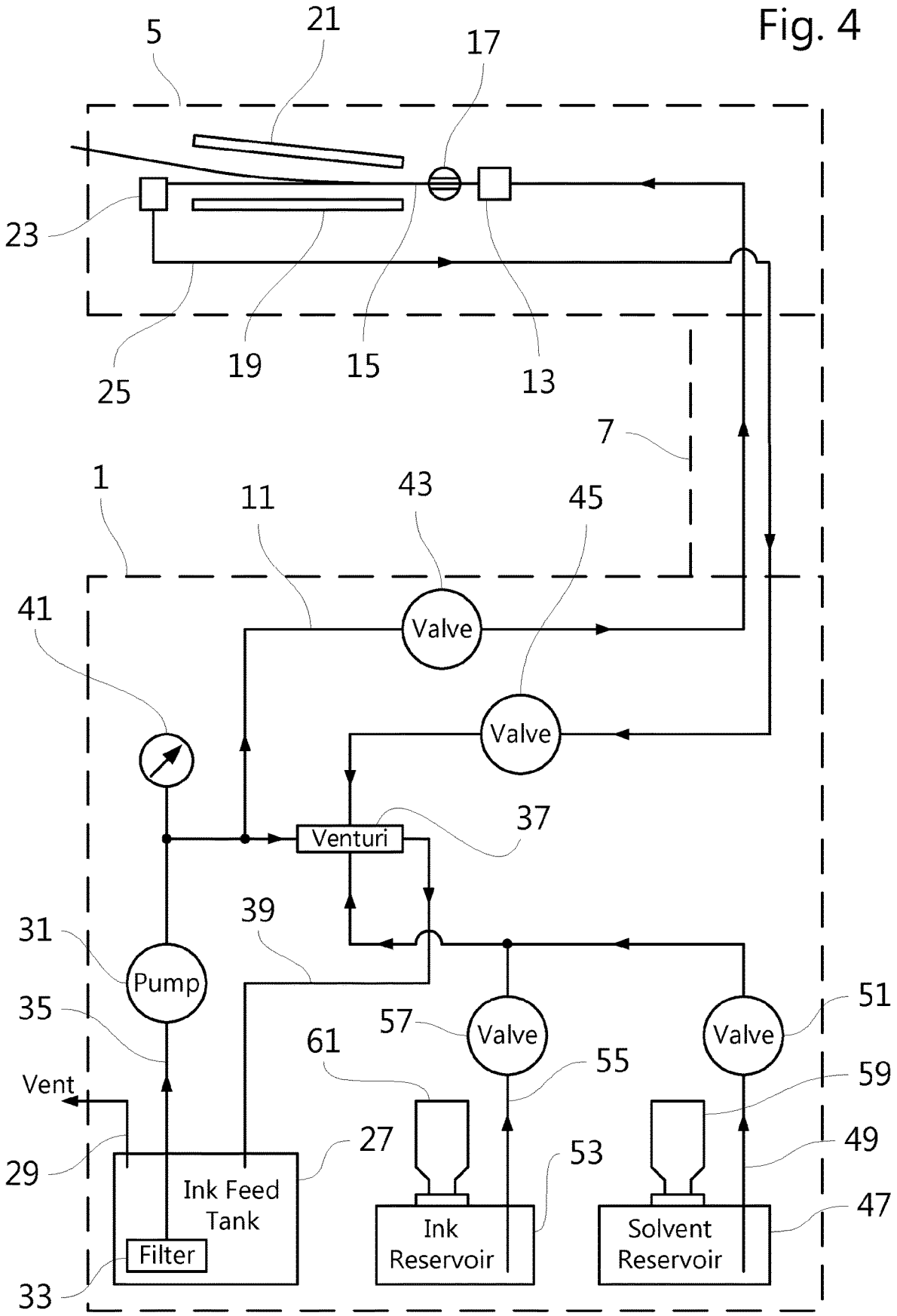
FIG. 4 shows simplified schematic diagram of the ink system (fluid system) of the printer of FIG. 1.

In the illustrated embodiments of the present invention, the continuous ink jet printer is an electrostatic deflection continuous ink jet printer.

FIG. 1 shows an electrostatic deflection type continuous ink jet printer. The printer forms a continuous jet of ink and has an arrangement of electrodes for charging drops of ink and deflecting the drops electrostatically in order to print a desired pattern. The main fluid and electrical components are housed within a main printer body 1. An operator communicates with the printer via a touchscreen display 3. The ink jet is formed within a print head 5, which also includes the electrode arrangement for charging and deflecting the ink drops, and the print head 5 is connected to the main printer body 1 by a flexible connection 7 known as a conduit or an umbilical. Drops of ink, deflected as necessary to create the desired pattern, travel from the print head 5 and strike the surface 9 of an object conveyed past the print head 5, in order to print the desired pattern on the surface 9 of the object. The print head 5 and the umbilical 7 may be disconnectable from the main printer body 1.

FIG. 2 is a schematic top view and FIG. 3 is a schematic side view of the main components of the print head 5. The terms "top view" and "side view" represent conventional directions from which to view the print head and do not necessarily correspond to the orientation of the print head when in use. Pressurised ink, delivered from the main printer body 1 through the umbilical 7, is provided via an ink feed line 11 to an ink gun 13. The pressurised ink leaves the ink gun 13 through a small jet-forming orifice to form an ink jet 15. Provided that pressurised ink is received by the ink gun 13 and any valves in the ink gun 13 are in the appropriate state, the ink jet 15 is formed continuously. Accordingly, this type of ink jet printer is known as a continuous ink jet printer, by contrast with a drop-on-demand printer in which a drop of ink is ejected only when a dot is to be printed.

Although the ink jet 15 leaves the ink gun 13 as a continuous unbroken stream of ink, it rapidly breaks into separate drops. The path of the ink jet passes through a slot in a charge electrode 17, which is positioned so that the ink jet 15 separates into drops while it is in the slot through the charge electrode 17. The ink is electrically conductive and the ink gun 13 is held at a constant voltage (typically ground). Accordingly, any voltage applied to the charge electrode 17 induces a charge into the part of the ink jet 15 that is in the slot of the charge electrode 17. As the ink jet 15 separates into drops, any such charge is trapped on the drops. Accordingly, the amount of charge trapped on each drop can be controlled by changing the voltage on the charge electrode 17.

The ink jet 15 then passes between two deflection electrodes 19, 21. A large potential difference (typically several kilovolts) is applied between those electrodes 19, 21 to provide a strong electric field between them. Accordingly, the drops of ink are deflected by the electric field and the amount of deflection depends on the amount of charge trapped on each drop. In this way, each ink drop can be steered into a selected path. As shown in FIG. 2, uncharged ink drops, which pass through the electric field without deflection, travel to a gutter 23 where they are caught.

Suction is applied to the inside of the gutter 23 by a suction line 25, and so the ink received by the gutter 23 is sucked away and returned through the umbilical 7 to the main printer body 1, for re-use.

Drops of ink that are deflected by the field between the deflection electrodes 19, 21, so as to miss the gutter 23, leave the print head 5 and form printed dots on the surface 9 of the object.

FIG. 4 is a simplified schematic diagram of a fluid system for the ink jet printer of FIG. 1. Ink is held in an ink feed tank 27 in the main printer body 1. The ink feed tank 27 is the main ink tank of the printer. The interior of the ink feed tank 27 is held at atmospheric pressure by a vent 29. Ink is sucked out of the ink feed tank 27 by a pump 31, via a filter 33 and an ink supply line 35. The ink, pressurised by the pump 31, flows through a Venturi 37 and back to the ink feed tank 27 via an ink return line 39. Ink will flow continuously around this loop as long as the pump 31 is running. Thus the loop comprising the ink feed tank 27, the ink supply line 35, the ink pump 31, the line from the pump 31 to the Venturi 37, the Venturi 37 itself, and the ink return line 39 provides an ink circuit. The flow of ink through the Venturi 37 generates suction and accordingly the Venturi acts as a suction source. A pressure transducer (pressure sensor) 41 is used to sense the ink pressure on the outlet side of the ink pump 31.

The ink feed line 11 is also connected to the outlet side of the ink pump 31 and receives pressurised ink. Thus the ink feed line 11 provides an ink feed path to supply pressurised ink from the ink circuit to the ink gun 13. An ink feed valve 43 controls the flow of ink through the ink feed line 11. The gutter suction line 25 returns ink from the gutter 23 through the umbilical 7 to the main printer body 1, and receives suction from the Venturi 37. Fluid flow in the gutter suction line 25 is controlled by a gutter valve 45.

During operation of the printer, the solvent in the ink used to form the ink jet 15 tends to evaporate, causing a change in the viscosity of the ink. In order to restore the ink to the correct viscosity, it is necessary to add further solvent from time to time. Spare solvent is held in a solvent reservoir 47 which receives suction from the Venturi 37 through a solvent top-up line 49. In order to add solvent to the ink, a solvent top-up valve 51 in a solvent top-up line 49 is opened briefly, allowing the Venturi 37 to suck a small quantity of solvent from the solvent reservoir 47. Solvent sucked in by the Venturi 37 joins the ink flow through the Venturi and therefore passes into the ink feed tank 27, so as to dilute the ink in the ink feed tank.

As the ink jet printer prints, it will slowly use up ink from the ink feed tank 27. When the ink level becomes too low, the ink feed tank 27 is topped up from an ink reservoir 53. Ink is sucked out of the ink reservoir 53 by the Venturi 37 via an ink top-up line 55, controlled by an ink top-up valve 57, in a similar manner to the operation for topping up with solvent from the solvent reservoir 47.

The solvent reservoir 47 and the ink reservoir 53 are supplied from a solvent container 59 and an ink container 61 respectively, and the operator replaces the containers 59, 61 as necessary. In practice, it is not always necessary to provide the solvent reservoir 47 and the ink reservoir 53, and the respective top-up lines 49, 55 may be connected directly to the containers 59, 61.

Figure 5:
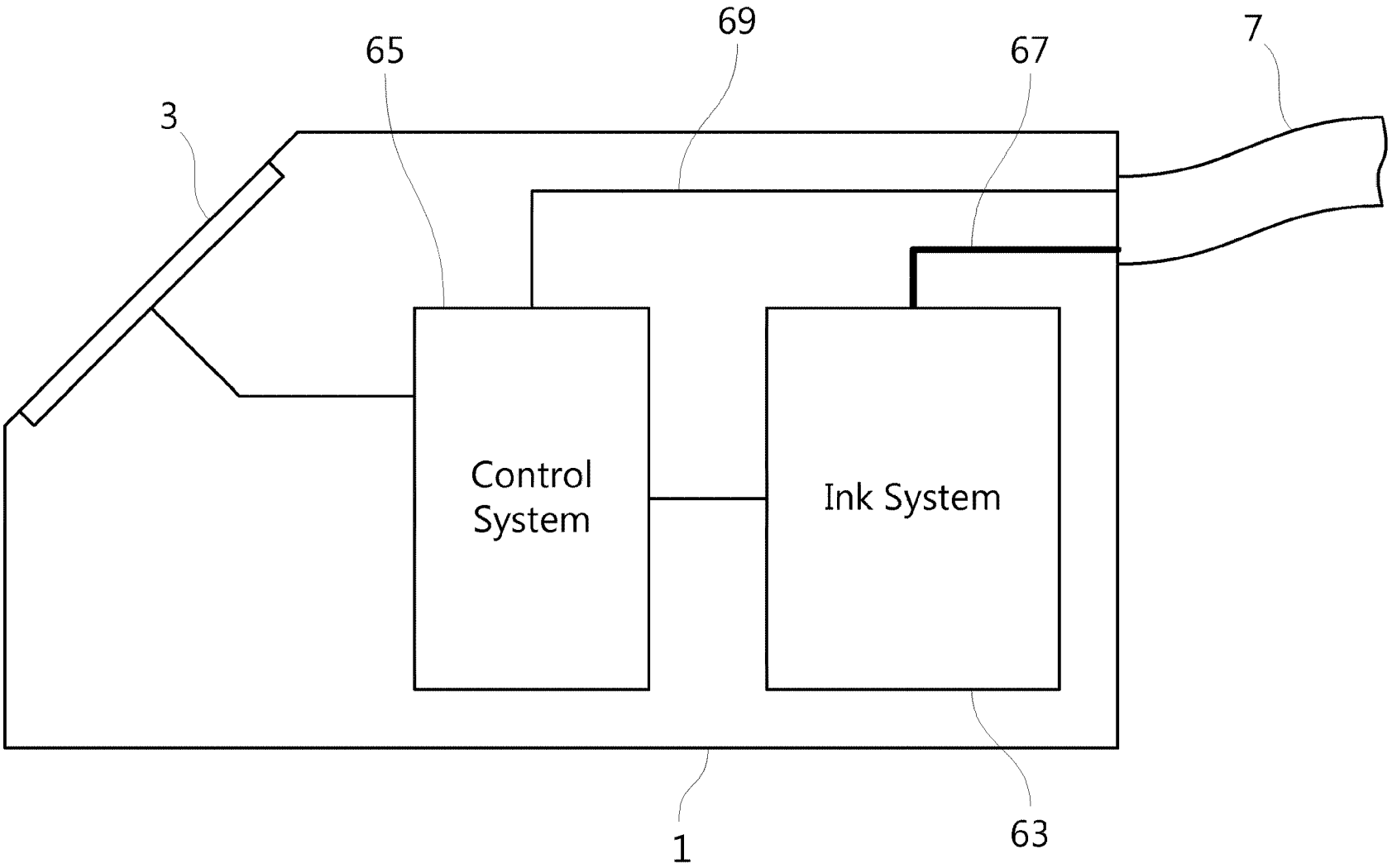
FIG. 5 shows the main components inside the main body of the printer of FIG. 1.

FIG. 5 shows schematically some of the components inside the main body 1 of the printer. The printer has a main body ink system 63, which includes the components in FIG. 4 that are shown inside the main printer body 1. The main body ink system 63 and other parts of the printer operate under the control of a control system 65. The control system 65, for example, sends drive currents to the ink pump 31 and to the various valves, 43, 45, 51, 57 of the main body ink system 63. The control system 65 receives outputs from the pressure sensor 41 and also from level sensors in the ink feed tank 27, the solvent reservoir 47 and the ink reservoir 53. The control system 65 also provides outputs to, and receives inputs from, the touchscreen display 3. Typically, the control system will include a processor such as a microprocessor and other electronic components as is well known in the art.

Fluid lines 67 connect the main body ink system 63 to the print head 5 through the umbilical 7. These fluid lines will include the ink feed line 11, the gutter suction line 25 and the purge line 43 shown in FIG. 4. Electrical lines 69 connect the control system 65 to the print head 5 via the umbilical 7. These electrical lines will include lines for applying the appropriate voltages to the charge electrode 17 and the deflection of electrodes 19, 21, and a drive signal to a piezoelectric crystal inside the ink gun 13 that applies a vibration to the ink that forms the ink jet 15 in order to control the manner in which it breaks into drops.

Figure 6:
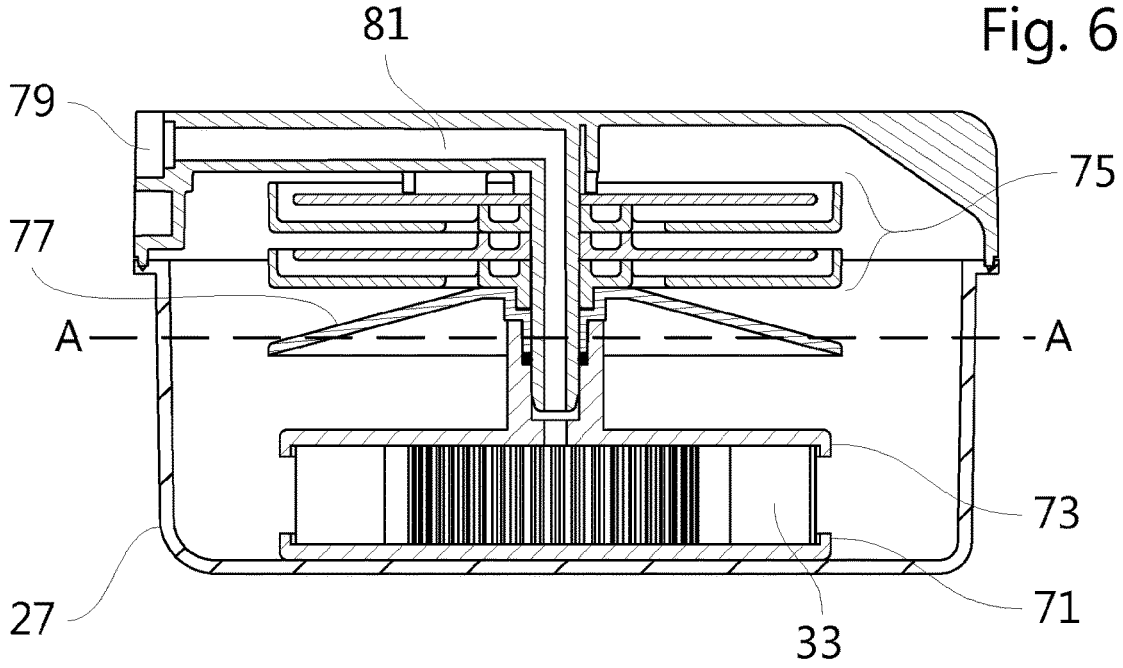
FIG. 6 shows a section through the ink tank of the printer of FIG. 1.

FIG. 6 is vertical section through the centre of the ink feed tank 27 showing the main components contained within it. In this embodiment, the ink feed tank 27, together with the components contained within it, forms a removable and replaceable service module that can be inserted into the main body 1 of the printer, and removed from it, by the operator. Inside the ink feed tank 27 there is a filter assembly made up of the ink filter 33, a filter base plate 71 and a filter top plate 73. The filter 33 is a pleated cylindrical filter, and is shown in section in FIG. 6 so that the inner pleated cylindrical surface is visible and the outer pleated cylindrical surface is not visible. A shroud is fitted to the filter assembly, surrounding the filter 33, but for ease of illustration the shroud is not shown in FIG. 6. Above the filter assembly there is an arrangement for promoting the separation of ink and air, made up of four flat plates 75 that provide a serpentine path for ink and air that enter the ink tank from the Venturi 37, and a sloping conical plate 77.

As can be seen in FIG. 6, the floor of the ink feed tank 27 is flat over substantially the entire area (width and breadth) of the ink feed tank 27, with a radius where it joins the side walls. The ink filter 33 sits at the bottom of the ink feed tank 27, with the filter assembly base plate 71 resting on the floor of the ink feed tank 27. The filter assembly top plate 73 has an upwardly extending central cylindrical extension, and the top of this supports the sloping conical plate 77 of the ink/air separator arrangement. This sloping conical plate 77 in turn supports the stack of four flat plates 75.

Fluid connections to the ink feed tank 27 are made at a port 79 at the top of a side wall. Three fluid connections are provided, corresponding to the three connections shown for the ink feed tank 27 in FIG. 4. One connection (not shown in FIG. 6) receives the ink and air mixture output from the Venturi suction device 37 via the ink return line 39, and delivers this ink/air mixture onto the topmost of the flat plates 75. The second connection (also not show in FIG. 6) allows air to flow from inside the ink feed tank 27 to the vent 29. The third connection (shown in FIG. 6) provides an ink outlet from the ink feed tank 27 to the ink pump 31 via the ink supply line 35. Ink that has passed through the filter 33 is carried by an ink outflow tube 81 from the space in the centre of the filter 33 up to the top of the ink feed tank 27 and then to the port 79 for connection to the ink supply line 35. Accordingly, while the ink pump 31 is operating, ink in the main volume of the ink feed tank 27 is sucked through the filter 33 and the ink outflow tube 81 out of the ink feed tank 27 and along the ink supply line 35 to the inlet of the ink pump 31. From the ink pump 31 the ink is driven through the Venturi 37 and along the ink return line 39 and re-enters the ink feed tank 27. While the ink jet 15 is running, unused ink from the jet is captured by the gutter 23, and suction developed by the Venturi 37 sucks the ink along the gutter suction line 25 so that it enters the Venturi 37 and joins the ink flow along the ink return line 39 to the ink feed tank 27. Suction at the gutter 23 also draws in air, which is also sucked down the gutter suction line 25 to the Venturi 37 and joins the ink flow along the ink return line 39 to the ink feed tank 27. Therefore when the ink jet 15 is running the ink re-entering the ink feed tank 27 from the ink return line 39 is mixed with air. The ink/air mixture from the ink return line 39 is delivered onto the topmost of the flat plates 75. The ink then flows over the flat plates 75 and the sloping conical plate 77 while air separates out from it, and re-joins the ink in the main volume of the ink feed tank 27. The amount of ink in the ink feed tank 27 is maintained so that the surface of the ink is slightly above the bottom of the sloping conical plate 77, as shown by the broken line A-A in FIG. 6. The arrangement of flat plates 75 and the sloping conical plate 77 allow the ink filter 33 to receive ink that is free of air bubbles. This is advantageous since the presence of air bubbles in the ink at the ink gun 13 would tend to disrupt the formation of the ink jet 15.

Figure 7:
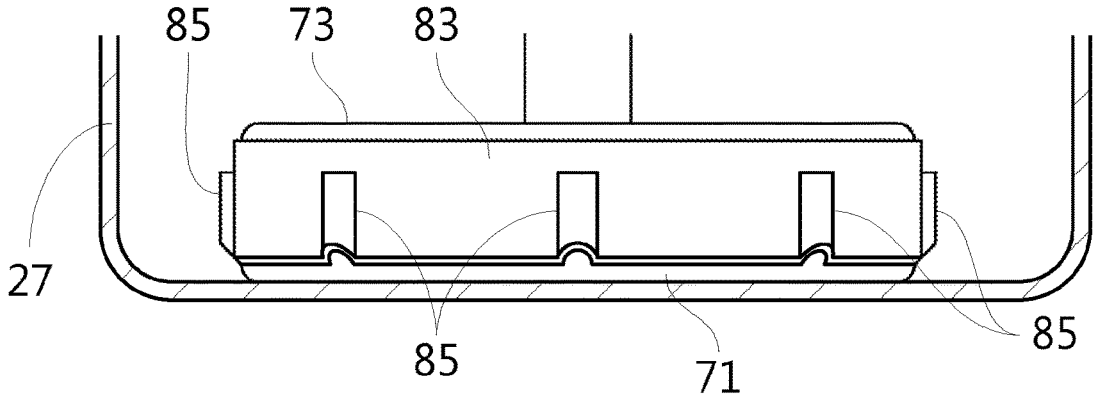
FIG. 7 shows a shroud fitted around the ink filter in the ink tank of FIG. 6, to provide nozzles.
Figure 8:
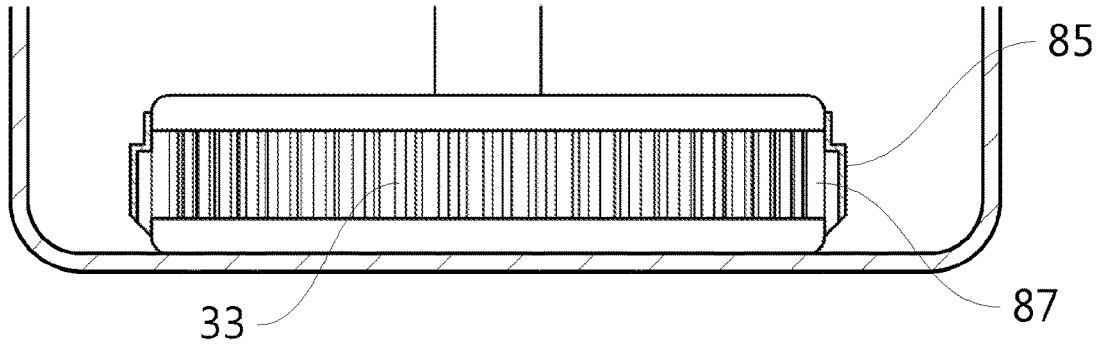
FIG. 8 shows a view similar to FIG. 7, with the shroud in section.

FIGS. 7 and 8 show the filter assembly in the ink feed tank 27, with the shroud 83 in place. FIG. 7 shows an external view of the shroud 83. In FIG. 8, the shroud 83 is in section but (in contrast to FIG. 6) the ink filter 33, the filter assembly base plate 71 and the filter assembly top plate 73 are not in section. The shroud 83 extends from the filter assembly top plate 73 to the filter assembly base plate 71, closing off the ink filter 33 from the ink in the ink feed tank 27, except where nozzles 85 enable ink to flow from the ink feed tank 27 to the filter 33. Preferably, there are a plurality of nozzles 85 spaced around the circumference of the shroud 83. For clarity of illustration, FIGS. 7 and 8 show an arrangement in which the shroud 83 has eight nozzles. In practice, more nozzles might be provided, for example there could be twelve or sixteen nozzles 85. In the embodiment of FIGS. 7 and 8 each nozzle is formed by a semi-cylindrical bulge in the shroud 83, and provides a semi-cylindrical flow path from a nozzle opening at the bottom of each nozzle 85 to the volume enclosed by the shroud 83. As shown in FIG. 8, the filter assembly base plate 71 and the filter assembly top plate 73 have a slightly larger diameter than the filter 33. Since the shroud 83 fits round the outside of the filter assembly base plate 71 and the filter assembly top plate 73, it encloses a circumferential space 87 around the outside of the filter 33.

During normal operation of the printer, the ink pump 31 sucks ink from the ink feed tank 27. The ink inside the ink feed tank 27 flows in through the opening at the bottom of each nozzle 85 and then via the nozzles 85 into the space 87 around the filter 33. From the space 87 the ink flows through the filter 33, the ink outflow tube 81 and the ink supply line 35 to the ink pump 31. The pressurised ink from the ink pump then flows through the Venturi 37 and the ink return line 39 back to the ink feed tank 27. If the ink jet 15 is running the pressurised ink also flows through the ink feed line 11 to the ink gun 13 to form the ink jet 15, and unused ink is caught by the gutter 23 and returns to the Venturi 37 along the gutter suction line 25. Thus the openings at the bottoms of the nozzles can be regarded as inlets or inlet openings or ink entrance openings to an ink flow path or ink supply path that comprises the nozzles 85, the space 87, the ink outflow tube 81 and the ink supply line 35. An ink return path is provided by the line from the ink pump 31 to the Venturi 37, the Venturi 37 itself, and the ink return line 39.

Because the total cross section of the ink flow paths through all the nozzles 85 is relatively small, the ink velocity through the nozzles 85 is relatively high. However, in order to minimise the pressure drop across the ink filter 33 it is desirable to provide a large filter area for the ink filter 33 and enable a low ink velocity through the filter 33. Therefore the ink filter 33 is pleated, and the space 87 inside the shroud 83 enables the ink that has entered through the nozzles 85 to circulate around the ink filter 33 and reach the entire area of the ink filter 33.

This arrangement is suitable for printing both with inks containing a pigment and with inks not containing a pigment. Alternatively, the shroud 83 may be provided if the printer is to be used with pigmented ink and may be omitted if the printer is to be used with non-pigmented ink. When a pigment-containing ink is used, the continual flow of ink from the ink feed tank 27 through the ink tank 31 and back into the ink feed tank 27 tends to keep the pigment dispersed within the ink. The relatively high ink velocity through the nozzles 85, and the consequent relatively high velocity of the ink flow in the ink feed tank 27 immediately adjacent the openings of the nozzles 85, also helps to keep the pigment dispersed.

However, if the printer is left unused for an extended period with a pigment-containing ink in the ink feed tank 27, the pigment may tend to settle out of the ink and accumulate on the floor of the ink feed tank 27. Accordingly, the printer can perform a mixing operation when it is started up, in order to re-disperse pigment that may have settled out. In the mixing operation, the ink pump 31 is used to drive a fluid (ink and/or air) in the reverse direction along the ink supply line 35 and into the ink feed tank 27 via the nozzles 85.

The relatively small total cross-sectional area of all the flow paths through the nozzles 85 results in a relatively high fluid flow velocity through them. This relatively high fluid flow velocity, combined with the downward direction of the reverse fluid flow out of the nozzles 85 into the ink feed tank 27, tends to agitate and disperse pigment that has settled onto the floor of the ink feed tank 27. The dispersed pigment is once again suspended in the ink. Subsequent normal operation of the ink pump 31 then sucks the ink and the suspended pigment in through the nozzles 85 to flow along the ink supply line 35 to the ink pump 31, and back through the Venturi 37 and the ink return line 39 to the ink feed tank 27. This rapidly provides an even mixing of the suspended pigment in the ink. Additionally, the agitation caused by this flow tends to break up any lumps where pigment particles have joined together. Optionally, the ink pump 31 may be a gear pump, which tends to break down any accumulated lumps of pigment that pass through it.

The reverse flow along the ink supply line 35 may also be useful to dislodge any accumulations of pigment in the path from the interior of the ink feed tank 27 to the ink pump 31, especially at the nozzles 85 or on the surface of the ink filter 33.

Because there are several nozzles 85 around the circumference of the shroud 83, the flow of fluid out through the nozzles 85 for disturbing settled pigment is directed to several different places on the floor of the ink feed tank 27. This increases the overall proportion of the ink tank floor where pigment is disturbed. Additionally, as shown in FIGS. 7 and 7 the lower ends of the nozzles 83 are cut at an angle (chamfered) so that the openings at the lower ends of the nozzles 85 face outwards as well as downwards. This tends to promote an outward component in the direction of flow of ink from the nozzles 25 to the floor of the ink tank 27, with result that the flow of ink tends to extend across the floor of the ink tank 27 away from the shroud 83, increasing the overall area of the floor of the ink tank 27 that receives the flow of fluid for dispersing settled pigment.

Figure 9:
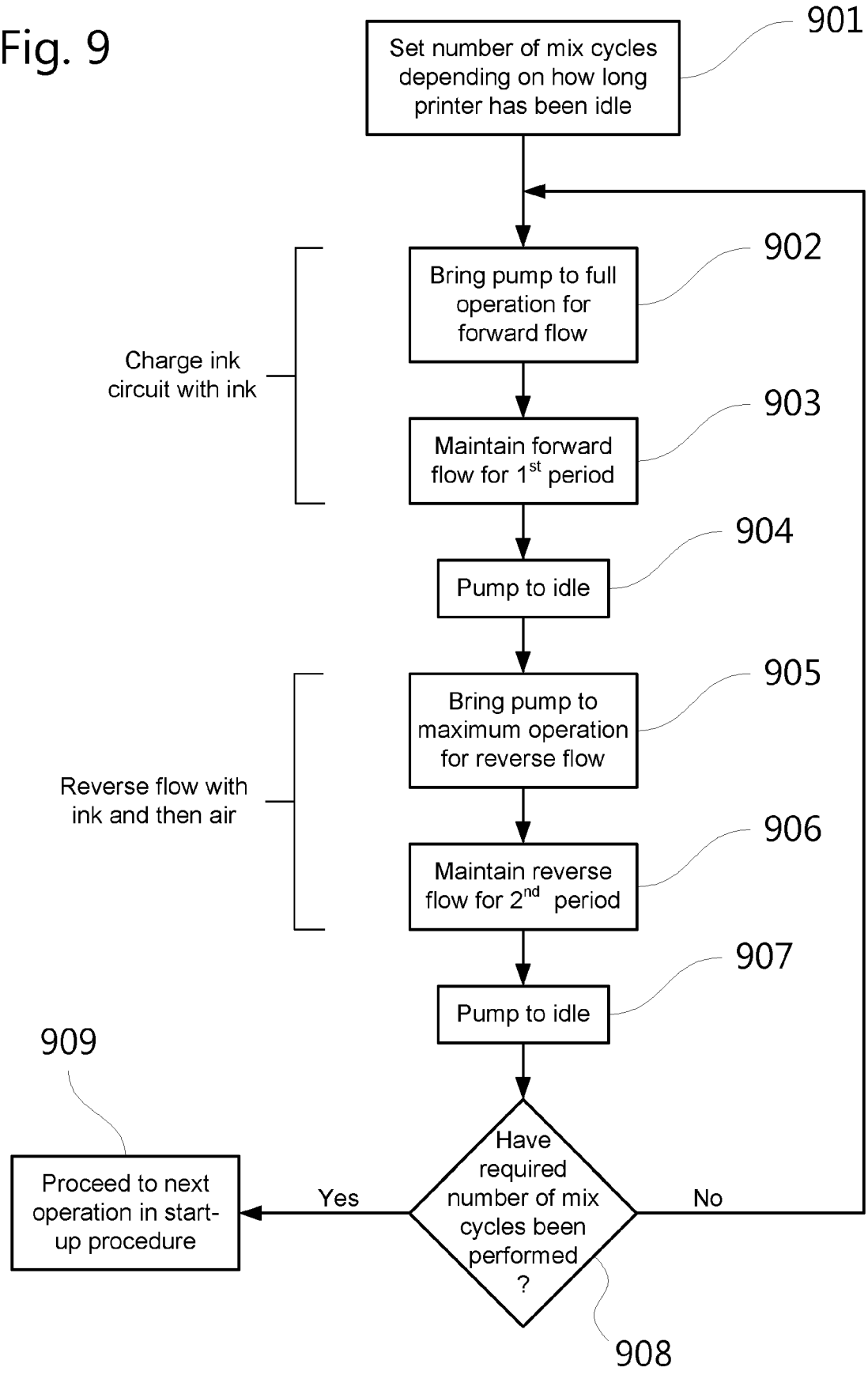
FIG. 9 is a flow diagram of an operation by the ink jet printer to disperse pigment that has settled on the floor of the ink tank.

An example of a mixing operation will now be described with reference to the flow diagram of FIG. 9.

When the printer is started up after a period of being idle, it performs a start-up routine. At a suitable point during the start-up routine the control system 65 may check whether the ink currently in the printer contains pigment, and if so it controls the printer to perform the ink mixing operation. Alternatively, the printer may perform the ink mixing operation in every case regardless of the type of ink. At the beginning of the ink mixing operation, the control system 65 determines how long the printer has been idle, i.e. how much time has elapsed since the printer was last active. As the length of time increases, the amount of pigment that will have settled out of the ink will increase. Therefore a greater amount of ink mixing will be required. Consequently, in step 901 the control system 65 sets the number of mixing cycles to be performed depending on how long the printer has been idle.

Assuming that the control system 65 determines that at least one mixing cycle is required, the operation moves onto step 902 in which control system 65 operates the ink pump 31 and brings it up to its normal full operating speed. Normally, whenever the ink pump 31 is turned on after being idle, its speed it increased gradually so as to increase the output ink pressure over a period rather than driving the pump 31 from stationary to full speed as quickly as possible. Accordingly, step 902 may take several seconds to complete. Once the pump has reached the desired operating speed, it is maintained in that state for a first predetermined period in step 903. The purpose of steps 902 and 903 is to pump ink from the ink feed tank 27 around the ink circuit (comprising the ink supply line 35, the ink pump 31, the Venturi 37 and the ink return line 39) in the same way as during normal operation of the printer, in order to ensure that the ink circuit is fully charged with ink in preparation for next phase of the mix cycle. In step 903 the first period is selected so as to be long enough to ensure that ink has circulated fully around the ink circuit and is returning back into the ink feed tank 27 via the ink return line 39.

Following the end of the first period in step 903, control system 65 returns the ink pump 31 to the idle state briefly in step 904 and then the reverse flow phase of the mix cycle begins with control system 65 controlling the pump 31 to operate at maximum speed in reverse in step 905. Normally, the pump 31 will be brought to its maximum reverse speed in step 905 as quickly as possible, in contrast to the more gradual increase in pump speed in step 902, in order to minimise the amount of ink driven through the pump 31 before it has reached its maximum reverse speed. Once the pump 31 has reached its maximum reverse speed, it is maintained in that condition in step 906 for a predetermined second period. Preferably, the predetermined second period of step 906 is longer than is required for all of the ink in the ink circuit to be discharged.

Therefore, during step 906, all of the ink in the ink circuit is driven out through the nozzles 85 into the ink feed tank 27 with the maximum velocity that the ink pump 31 is able to provide. This generates a strong liquid flow within the ink tank 27, directed at the floor of the ink tank by the nozzles 85, so as to dislodge pigment that has settled on the floor of the ink tank 27. While the ink is being discharged from the nozzles 85, air from the top of the ink feed tank 27 is sucked into the ink return line 39. Once all of the ink in the ink circuit has been discharged through the nozzles 85, and the ink circuit is filled with air, the continued operation of the ink pump 31 in reverse drives air out of the nozzles 85 into the ink tank 27 for the remainder of the second period in step 906. This air flow into the bottom of the ink feed tank 27 continues to agitate the ink and tends to mix the dislodged sediment thoroughly into the ink in the ink tank 27.

At the end of the second period, control system 65 returns the ink pump 31 to the idle state in step 907, and the mixing cycle is complete. Then, in step 908 the control system 65 determines whether the printer has yet carried out the required number of mix cycles as decided in step 901. If the required number of mix cycles have not yet been performed, the operation returns to step 902 in order to perform another mix cycle. Once it is determined in step 908 that the required number of mix cycles have been performed, the mixing operation is completed and in step 909 the printer moves on to the next operation in the start-up procedure.

One specific example of a printer, which has been tested, used a shroud 83 generally as shown in FIGS. 7 and 8 but having sixteen nozzles 85. This was fitted around a filter assembly having a diameter of 100 mm in the manner shown in FIGS. 7 and 8. As shown in FIGS. 7 and 8, each nozzle 85 had the shape of a semi-cylinder, and provided a semi-cylindrical recess in the inner side of the shroud 83 so as to provide the nozzle flow path. Each semi-cylindrical recess had a radius of about 1 mm, so that the total cross sectional area of all the nozzle paths combined was about 25 $mm^2$. By way of comparison, the pipework used for the ink supply lines 35, the connection from the pump 31 to the Venturi 37 and the ink return line 39 had an internal radius of 2 mm and an internal cross section of about 12½% $mm^2$. During normal full speed forward operation of the pump 31, ink flows around the ink circuit with a volume flow rate of about 7400 $mm^3$ per second, resulting in an ink velocity in the ink supply line 35 and the ink return line 39 of about 600 millimetres per second (0.6 m/s), and a velocity through the nozzles 85 of about 300 millimetres per second (0.3 m/s).

This design was tested with a pigmented ink, and by way of comparison a test was also done using the same design of printer but omitting the shroud 83 so that the arrangement of parts inside the ink tank 27 resembled that shown in FIG. 6. The arrangement without the shroud is known to work satisfactorily with inks having a dye but no pigment.

The absence of the shroud 83 means that ink passing from the bottom of the ink feed tank 27 through the filter 33 and into the ink outflow tube 81 can approach the filter assembly around its entire circumference and over the full height of the space between the filter assembly base plate 71 and the filter assembly top plate 73. Therefore, assuming that the volume flow rate provided by the ink pump 31 remains the same, the absence of the shroud 83 results in a much lower ink velocity at the bottom of the ink feed tank 27.

It was found that if the printer was operated continuously, the arrangement with the shroud 83 enabled the pigment to remain suspended in the ink sufficiently that no loss of opacity in the printer output of the printer was detected. However, in the absence of the shroud 83 there was eventually a detectable loss of opacity in the print out, indicating that a significant amount of pigment had settled out of the ink. It is assumed that the increased ink velocity at the nozzles 85 enabled the design having the shroud 83 to be more effective at keeping the pigment in suspension.

With the detailed example described above, the ink pump 31 was operated at maximum reverse flow to provide a volume of flow rate of about 9300 $mm^3$ per second, resulting in an ink velocity in the ink supply line 35 and the ink return line 39 of about 750 millimetres per second (0.75 $ms^{-1}$) and an ink velocity out through the nozzles 85 into the ink feed tank 27 of about 370 millimetres per second (0.37 $ms^{-1}$).

With this design, the mix cycle as described with reference to FIG. 9 was conducted so that in step 902 it took 20 seconds to increase the pump speed steadily from idle to its normal full forward speed. The first period of step 903, for which the pump was maintained at its normal full forward speed, was 8 seconds, and in step 904 it was returned to the idle state for 2 seconds. In step 905, the pump was brought to the maximum reverse flow operation in 2 seconds, and in step 906 the second period, in which the pump was maintained at its maximum reverse speed, was 12 seconds. Then in step 907 the pump was returned to the idle state for 3 seconds. The ink circuit contained approximately 23 millilitres of fluid. Accordingly, while the ink circuit was charged with ink in steps 902 and 903, there was a significant flow of ink around the ink circuit and back into the feed tank 27, with approximately 170 ml of ink being driven around the ink circuit. In the reverse flow phase, all the ink in the ink circuit was driven out through the nozzles 85 during the first 3 seconds of step 906, and during the remaining 9 seconds of step 906 air was driven out through the nozzles 85.

If the printer is left idle for an extended period, the pigment tends to settle out of the ink and a mixing operation can be performed to disturb the settled pigment and mix it back into the ink. This was tested using the printer used in the example discussed above. The printer was allowed to sit idle for approximately 3 weeks. At the end of this period, sufficient pigment had settled out of the ink so that when the printer was started up the opacity of the print out was noticeably reduced. When the printer was used without a shroud 83, a mixing cycle as discussed above was not sufficient to re-disperse enough pigment to provide good opacity to the ink. However, opacity was provided when the mixing cycle was performed with the arrangement using the shroud 83.

It is proposed that the number of mixing cycles performed during start-up of the printer should depend on the length of time that the printer has stood idle. With the specific example discussed above, it is proposed that the printer can restart without any mixing operation if it has been idle for less than 4 hours. The mixing operation should include two mixing cycles if the printer has been idle for a period between four hours and two days. The mixing operation should include 3 mixing cycles if the printer has been idle for a period between two days and one week. There should be five mixing cycles if the printer has been idle for a period between one week and two weeks. If the printer has been idle for more than two weeks, it is proposed that the mixing operation should include ten mixing cycles.

The embodiment described above provides a simple, cheap and compact arrangement for enabling a continuous ink jet printer to work with pigmented ink. Compared with the design used for inks containing dye but no pigments, the only design change is a provision of the shroud 83 so as to create nozzles 85. The design enables pigmented ink to be used in a printer with an ink tank 27 having a flat floor for substantially the entire area of the ink tank, and therefore it avoids the wasted space associated with the use of a conical-floored ink tank. There is no need to provide an extra component beneath the ink tank, as there is in magnetic stirrer arrangements, thereby avoiding the cost and loss of space associated with such components, and equally there is no need to provide additional components such as special pipe work to introduce ink flows at the floor level of the ink, which can take up space around the tank.

In the mixing operation described with reference to FIG. 9, both ink and air are driven out of the nozzles 85 during the reverse flow period. As an alternative, it is possible to provide only air during the reverse flow period, by omitting steps 902, 903 and 904 so that the ink circuit is not charged with ink before the pump is operated for reverse flow in step 905. However, this is less preferred. First, the period of forward flow ensures that ink flows through the pump 31, thereby wetting the pump and ensuring that it can operate efficiently. Additionally, it is desirable to obtain a good flow of ink across the floor of the ink tank 27 in order to disturb pigment that has settled. As movement is transmitted from the fluid driven out through the nozzle 85 to the ink in the ink tank 27, momentum must be conserved. Since the ink has a greater density than air, a flow of ink through the nozzles 85 will have a greater momentum than a flow of air with the same velocity, and therefore it is more effective in creating a strong ink flow across the floor of the ink feed tank 27.

It is also possible for the reverse flow period to provide only a reverse flow of ink, and no reverse flow of air. This can be done, for example, by ending step 906 no later than the supply of ink in the ink circuit is used up. However, unless the ink circuit is designed so it contains an unusually large volume of ink, or a design modification is provided to enable ink to be sucked out of the ink tank 27 during the reverse flow phase of the mix cycle, the period of reverse flow during each mix cycle will inevitably be brief (about 3 seconds in the example discussed above). Therefore it is normally preferable to extend the period of reverse flow and include some reverse flow of air. Additionally, the air bubbles rise through the ink tank 27 owing to the buoyancy of the bubbles and this tends to promote vertical mixing within the ink, helping to disperse the pigment that has been dislodged by the initial reverse flow of ink.

In the example described above, the ink pump 31 was operated in the forward flow step at its normal full speed for forward operation. This is the maximum pump speed that is permitted during normal printing operation, when the ink jet 15 is running. However, it is also possible to operate the ink pump 31 at a higher forward speed during the forward flow step of an ink mixing cycle, since the ink jet will usually not be running at this time. The higher forward speed will increase the ink flow rate in through the entrance openings of the nozzles 85, and this will enhance the tendency of the ink flow to disturb the pigment during the forward flow step. For example, the pump could operate at the same speed in the forward flow step as in the reverse flow step. In the example given above, this results in a flow rate that is about 1¼ times the normal full speed for forward operation while the ink jet 15 is running. The pump speeds in both the forward and the reverse flow steps may be increased further if the pump is capable of this and the remainder of the ink circuit can withstand the higher flow rates and higher ink pressures. For example, the pump speeds could be 2½% time the maximum pump speed that is permitted during normal printing operation. These higher speeds will enhance the disturbance of pigment during the mixing cycle.

In the embodiment of FIGS. 7 and 8, the nozzles 27 provide vertical semi cylindrical flow paths, but a chamfered edge around the bottom of the shroud 83 means that the openings at the bottom of each nozzle 85 are angled, with the result that the ink flow into and out of the nozzle openings tends to have a sideways component. This sideways component of the flow direction increases the spread of the flow plume during the reverse flow and increases the region of localised disturbance caused by ink flow into the nozzle during normal forward flow. However, other nozzle designs are also possible.

In general, the nozzles should either face towards the floor of the ink feed tank 27 or should be situated at the floor of the ink feed tank and face across it. This enables the flow of ink out of the nozzles 85 during reverse flow to interact with sediment that has accumulated on the floor of the ink tank. It also enables the localised ink disturbance caused by ink flow into the nozzles during normal operation to agitate pigment that might be falling towards the floor, and thereby to tend to mix it back into the ink.

Figure 10:
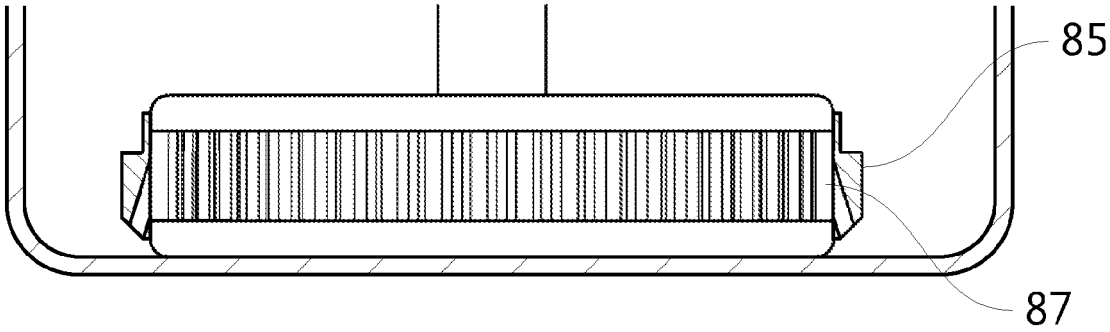
FIG. 10 is a view similar to FIG. 8 for an alternative design of shroud having angled nozzles.

An alternative nozzle design is shown in FIG. 10, which is a view similar to FIG. 8 of an embodiment in which the shroud 83 is modified. In FIG. 10, each nozzle 85 provides an angled ink flow path through it, rather than a vertical flow path as in FIG. 8. This design can be effective to ensure that the direction of ink flow into and out of the nozzle includes a horizontal component, for the purpose of increasing the area on the floor of the ink feed tank 27 that is subjected to disturbance by ink flow through the nozzle 85.

Figure 11:
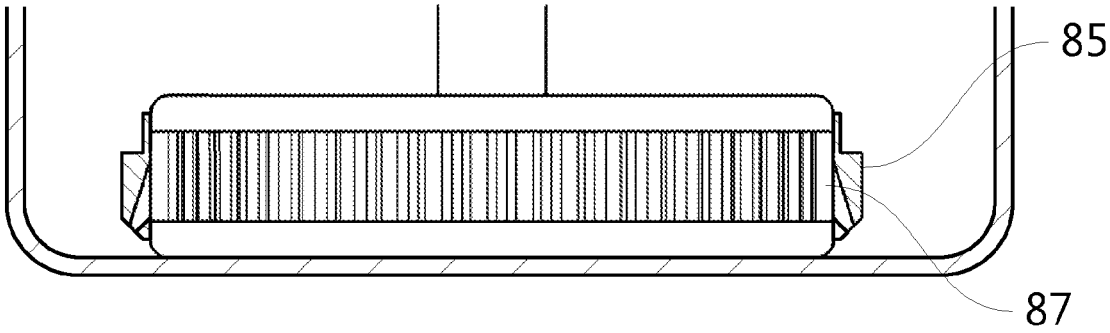
FIG. 11 is a view similar to FIG. 8 for a further alternative design of shroud having tapered nozzles.

A further embodiment is shown in FIG. 11, in which the sides of the path through the nozzle 85 converged towards the nozzle opening. This tends to increase the flow velocity through the nozzle opening. It will also tend to alter the geometry of the flow plume created by the nozzle during reverse flow, and will therefore alter the way in which the reverse flow affects pigment that has settled on the floor of the ink feed tank 27. It is also possible to angle the sides of the flow path through the nozzle so that they diverge towards the nozzle opening, which will reduce the nozzle velocity but increase the width of the flow plume.

Figure 12:
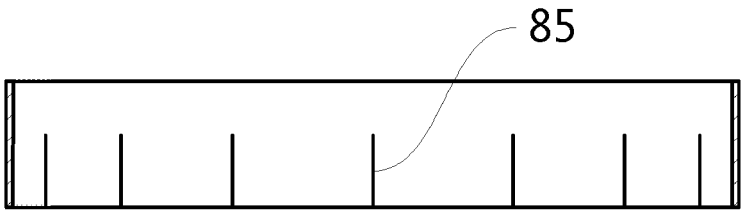
FIG. 12 shows schematically an arrangement for nozzles to extend straight downward in the shroud.

Other designs are possible. For example, as shown more schematically in FIG. 12, the nozzles 85 can provide vertical flow paths around the shroud 83, with no chamfered edge, so that the nozzle openings are horizontal and flow from and to the ink tank 27 into and out of the nozzles 85 is essentially vertical.

Figure 13:
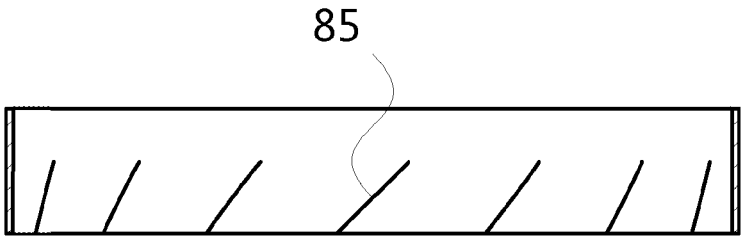
FIG. 13 shows schematically an arrangement for nozzles to be angled spirally around the shroud.

As shown in FIG. 13, the nozzles 85 can spiral round the shroud 83, so that the ink flow into and out of the nozzle openings is in a direction that has a component which is circumferential of the shroud 83.

The various possibilities for varying the positioning and internal geometry of the nozzles 85, as illustrated in the embodiments discussed above, provide the designer with options for adjusting the design of the nozzles 85 to suit the particular geometry of the ink tank in which the system will be used.

Figure 14:
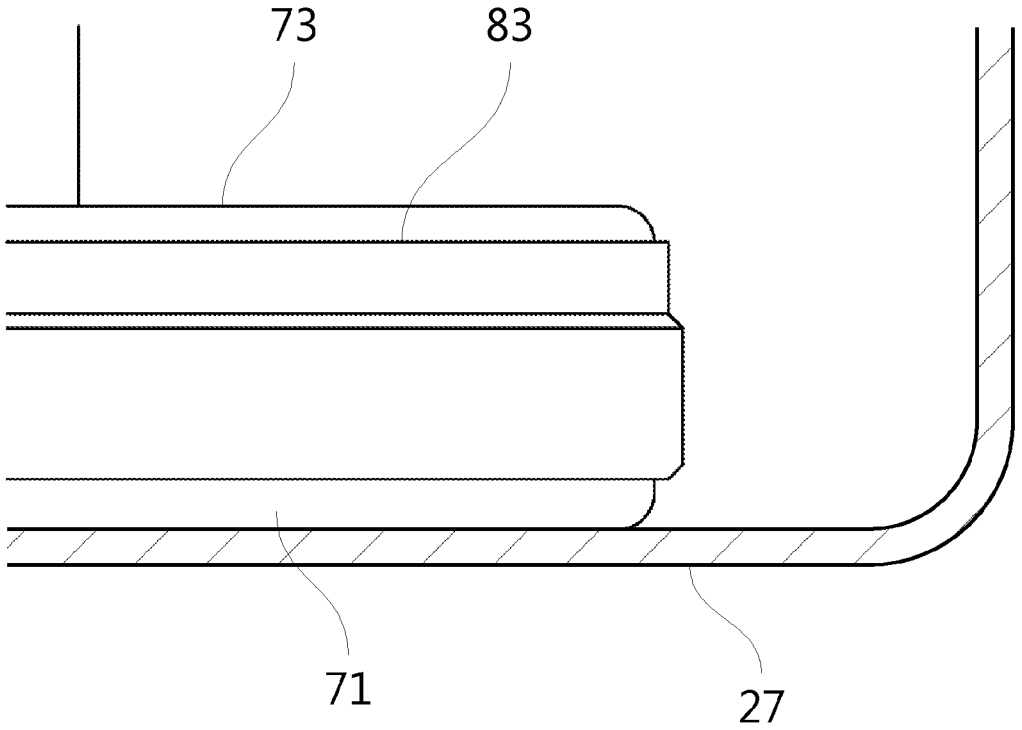
FIG. 14 is an enlarged view similar to FIG. 7 for a shroud providing a single nozzle extending circumferentially around the filter.
Figure 15:
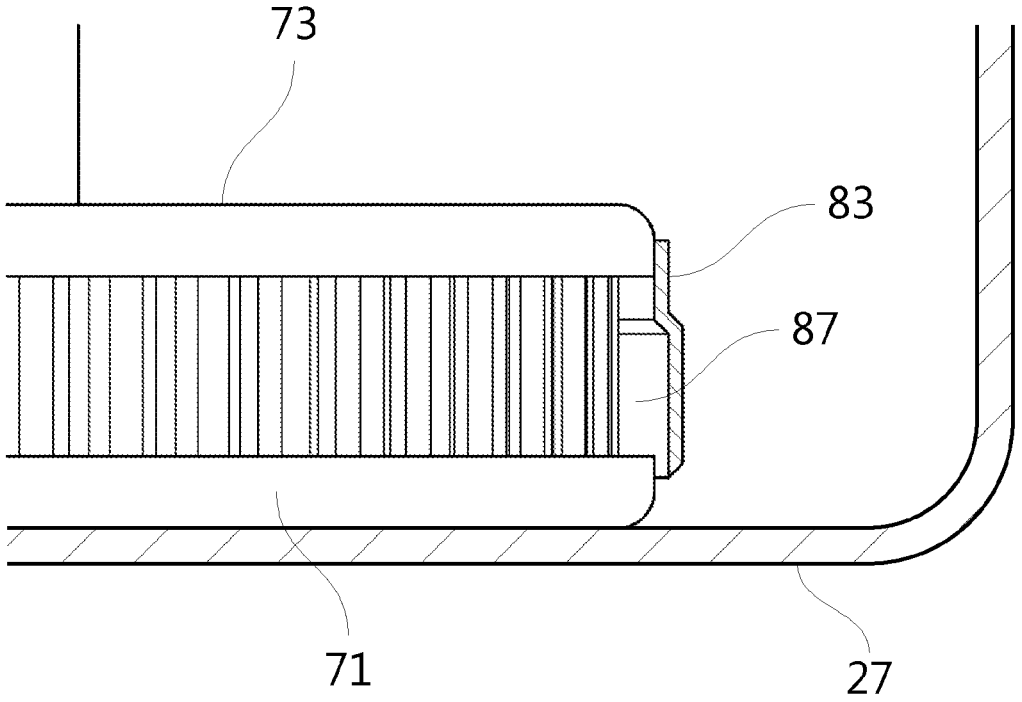
FIG. 15 is a view similar to FIG. 14, with the shroud in section.

It is also possible to replace the nozzles 85 by a single nozzle that extends around the entire circumference of the shroud 83. This is shown in FIGS. 14 and 15, which respectively show the shroud 83 from the outside and show it in section, in a similar way to FIGS. 7 and 8. In this case, the nozzle opening extends around the entire circumference of the filter assembly, and in order to provide the required cross sectional area for the nozzle opening, the space between the bottom of the shroud 83 and the filter assembly base plate 71 must be very small. For example, in the detailed construction described above the filter assembly is 100 mm in diameter and therefore 314 mm in circumference. The total nozzle area is about 25 $mm^2$. Consequently, the gap between the shroud 83 and the filter assembly base plate 71 needs to be less than 0.1 mm to provide the correct total cross sectional area. Therefore this design is less preferred than designs using multiple nozzles, because the necessary manufacturing tolerances tend to make it expensive.

Figure 16:
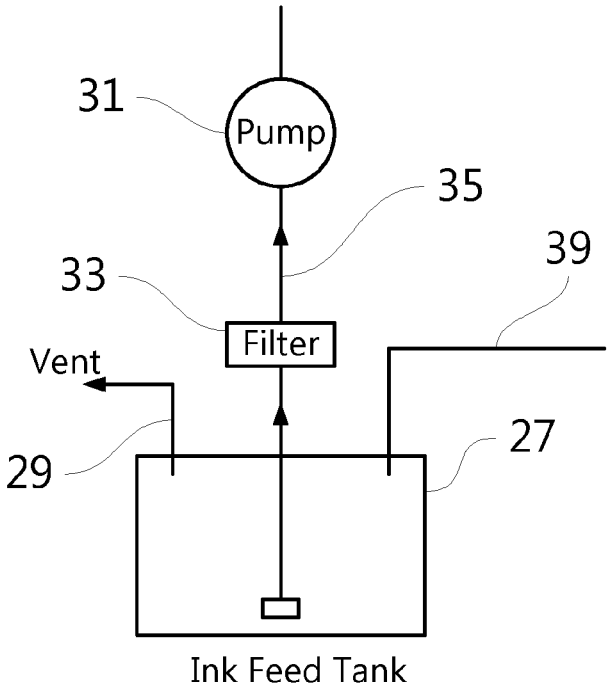
FIG. 16 is a schematic diagram of part of the ink system, showing an alternative system with the filter outside the ink tank.
Figure 17:
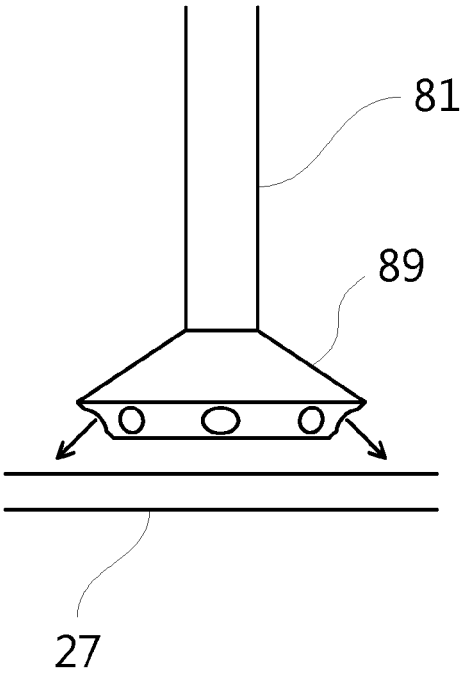
FIG. 17 shows an arrangement of nozzles at the end of the ink outflow tube in the ink tank in the absence if the ink filter.
Figure 18:
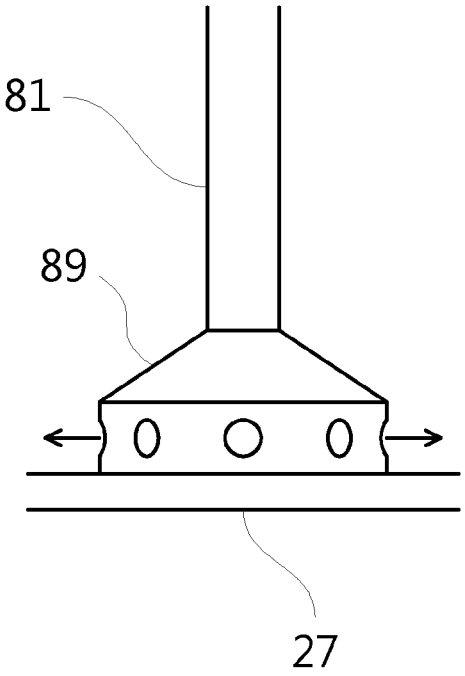
FIG. 18 shows a further arrangement of nozzles at the end of the ink outflow tube in the ink tank in the absence if the ink filter.

In the embodiments described above, the nozzles 85 have been provided by a shroud 83 fitted around the filter assembly. However, the nozzles 85 can be provided in other ways. For example, as shown in FIG. 16, the ink filter 33 may not be provided inside the ink feed tank 27 at all, but may be provided in the ink supply line 35 between the ink feed tank 27 and the ink pump 31. In this case, the ink outflow tubes 81 in the ink feed tank 27 extends further down towards the bottom of the ink feed tank 27 than is shown in FIG. 6, and may have an enlarged diameter fitting 89 at the end, as shown in FIGS. 17 and 18, to provide the nozzles 85. The fitting 89 has an enlarged diameter in order to accommodate a sufficient number of nozzles 85 and also in order to spread the nozzles 85 out over a larger area of the floor of the ink feed tank 27 and thereby increase the area of the floor of the ink tank 27 where settled pigment is disturbed by the fluid flow out of nozzles 85.

In FIG. 17 the fitting 89 is suspended slightly above the floor of the ink tank 27 and the nozzles 85 face downwardly and outwardly. Accordingly, when the ink pump 31 operates in reverse the fluid flow out through the nozzles 85 have a direction that is partially downwards and particularly outwards, as shown by the arrows in FIG. 17. In the alternative construction in FIG. 18, the nozzles 85 face outwardly, and the fluid flow out through the nozzles is horizontal, as shown by the arrows. In this case, the nozzle 85 are very close to the floor of the ink feed tank 27 so that the horizontal flow dislodges the pigment that has settled on the floor, and in this case the fitting 89 can rest on the floor of the ink feed tank 27 as shown in FIG. 18.

Figure 19:
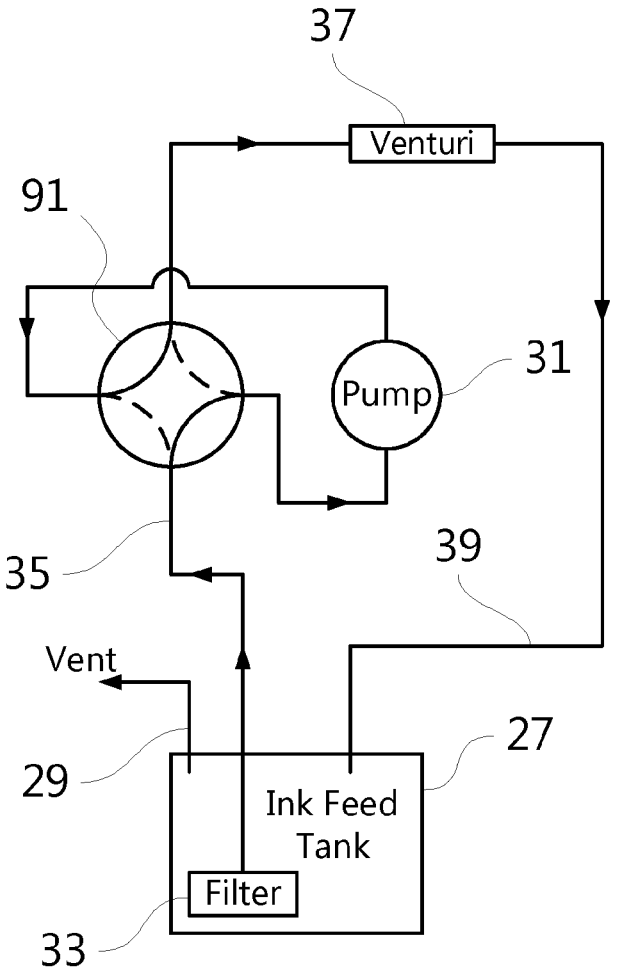
FIG. 19 is a schematic diagram of part of the ink system, showing an arrangement for providing reverse flow without needing the ink pump to operate in reverse.

Preferably the ink pump 31 is reversible, in order to provide the reverse flow of fluid out through the nozzle 85. In this way, the ink pump 31 is an example of a reversible ink drive arrangement or an ink pump arrangement that is operable in both a forward direction and a reverse direction. However, a non-reversible pump can be used provided that there is an arrangement to enable fluid to be driven in the reverse direction along the ink supply lines 35 and the ink return line 39. For example, a valve arrangement may be provided to switch the route of fluid flow around the ink circuit in order to enable both forward and reverse flow. An example of such an arrangement is shown in FIG. 19, where the ink pump 31 is not reversible and a spool valve 91 can switch the inlet and outlet connections of the pump 31 between the ink supply lines 35 and the line to the Venturi 37. In FIG. 19, if the spool valve 91 connects the lines together as shown in the unbroken lines through the valve 91, the pump 31 drives fluid around the ink circuit in the forward direction. If the spool valve 91 is operated so as to make the connections shown in broken lines and not the connections shown in unbroken lines, the effect of the pump 31 will be to pump fluid around the ink circuit in reverse direction, even though the direction of fluid flow through the pump 31 does not change. Thus in FIG. 19 the pump 31 is operable to drive fluid around the ink circuit in both the forward direction and the reverse direction even though the pump is not itself reversible. The pump 31 and the valve 91 together provide a reversible ink drive arrangement or an ink pumping arrangement operates in a forward direction and in a reverse direction.

As a further alternative to the mixing operation described with reference to FIG. 9, it is also possible to provide only the forward flow of ink during a mix cycle, and omit the reverse flow period. In this case, the mix cycle comprises steps 902 to 904, but steps 905 to 907 are omitted. Although the mixing operation is normally more effective at disturbing settled pigment if reverse flow is included, adequate disturbance of settled pigment may be provided by forward flow alone, especially if the pump 31 is operated at a higher speed for forward flow in the mixing operation than when the ink jet 15 is running. The mixing operation may omit reverse flow entirely if it is undesirable, for reasons of cost or space inside the printer, to provide a reversible ink pump or an arrangement (such as in FIG. 19) to allow reverse flow even without a reversible pump.

If reverse flow is omitted entirely, it is preferred that the ink flow rate into the openings at the bottoms of the nozzles 85 is at least 0.3 m/s, and more preferably at least 0.5 m/s in order to reduce the time needed to disturb an adequate amount of the settled pigment. In the example of a printer described above, a flow rate through the nozzles 85 of about 0.6 m/s enables the mixing cycle without any reverse flow step to disturb the settled pigment in approximately the same time as a mixing cycle as described with reference to FIG. 9, where the flow rate through the nozzles was about 0.3 $ms^{-1}$ in the forward flow step and about 0.37 $ms^{-1}$ in the reverse flow step.

Figure 20:
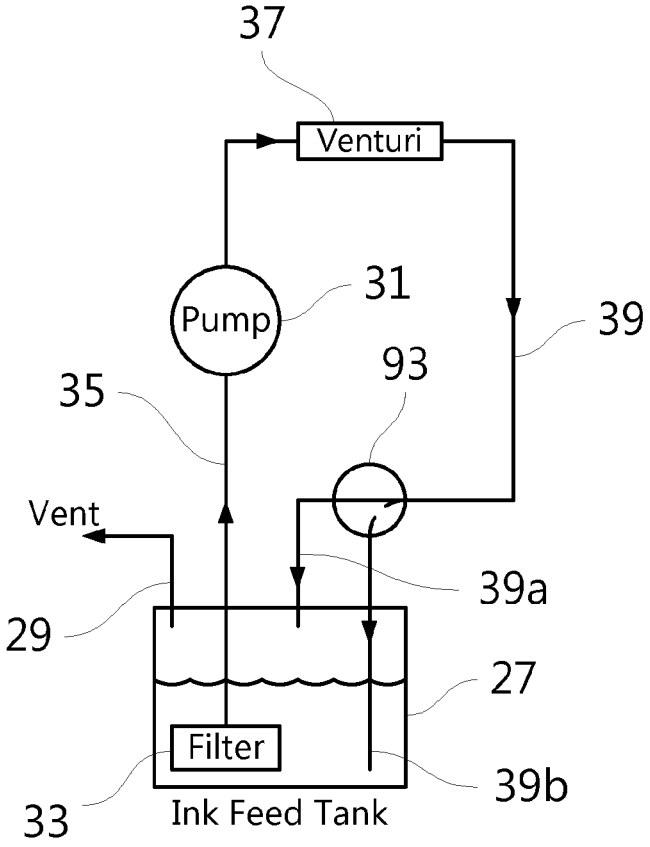
FIG. 20 is a schematic diagram of part of the ink system in which the ink return line is branched.

In the embodiments described above, the ink return line 39 opens into the interior of the ink feed tank 27 at a location above the normal level of the ink surface (shown by the broken line A-A in FIG. 6). FIG. 20 shows an alternative arrangement, in which the ink return line 39 branches. A first branch 39*a* opens into the interior of the ink feed tank 27 above the ink surface level and a second branch 39*b* opens in to the interior of the ink feed tank 27 below the ink surface level, as shown in FIG. 20. A valve 93 in the ink return line 39 selects which branch is used.

During normal operation of the printer, when the ink jet 15 is running, the first branch 39*a* is used so that the ink and air in the ink return line 39 are delivered into the space above the ink in the ink feed tank 27. However, during the ink mixing operation the second branch 39*b* may be used for all or part of a reverse flow step or for all or part of a forward flow step or for all or part of both.

If the second branch 39*b* is used during a reverse flow step, ink will enter the ink return line 39 instead of air, and a longer period of ink flow out through the nozzles 85 is possible. This can help to disturb the settled pigment on the floor of the ink tank 27.

If the second branch 39*b* is used during a forward flow step, the ink returning to the ink tank 27 will flow directly into the ink already in the ink tank 27, and this will increase the movement of ink within the ink feed tank 27 and will this help to disturb the settled pigment. If the second branch 39*b* of the ink return line 39 opens into the interior of the ink feed tank at or near the bottom of the tank, as shown in FIG. 20, and the opening faces parallel or at least partially towards the floor of the ink tank 27, the flow of ink into the ink tank from the ink return line during the forward flow step will be effective to disturb pigment that has settled on the floor of the ink tank 27. In this case, the second branch 39*b* of the ink return line 39 may have multiple openings into the interior of the ink feed tank 27, e.g. using a fitting similar to the fitting 89 described with reference to FIGS. 17 and 18, in order to enhance the ability of the ink flow from the ink return line 39 to disturb the pigment on the floor of the ink feed tank 27. Such an arrangement is particularly useful if the reverse flow step is not used at all during the ink mixing operation.

The embodiments described above are provided by way of non-limiting example, and other embodiments are possible.

What is claimed is:

1. A continuous ink jet printer comprising an ink circuit, the ink circuit comprising an ink tank, an ink pump arrangement, an ink supply path from one or more ink inlet openings inside the ink tank to the ink pump arrangement and an ink return path from the ink pump arrangement to the interior of the ink tank, the printer further comprising a control system arranged (a) to control the ink pump arrangement to pump ink around the ink circuit in a forward direction, in which the ink flows from the interior of the ink tank through the one or more ink inlet openings and along the ink supply path to the ink pump arrangement, and from the ink pump arrangement along the ink return path back to the interior of the ink tank, and (b) to control the ink pump arrangement to pump fluid around the ink circuit in a reverse direction, in which the fluid flows from the interior of the ink tank along the ink return path to the ink pump arrangement, and from the ink pump arrangement along the ink supply path and through the one or more ink inlet openings back to the interior of the ink tank.

2. A continuous ink jet printer according to claim 1 which comprises an ink gun, an ink feed path from the ink return line to the ink gun, a suction source, a gutter and a gutter path from the gutter to the suction source, the suction source being connected to return ink received by it to the interior of the ink tank, and the control system is arranged to control the printer to operate (a) in a jet forming mode in which the ink pump arrangement pumps ink around the ink circuit in the forward direction and ink is allowed to flow along the ink feed path to the ink gun and out though the ink gun to form an ink jet, and in which ink in the ink jet that is not used for printing is caught by the gutter and is sucked from the gutter along the gutter path to the suction source, and (b) in an ink mixing mode in which the ink pump arrangement pumps fluid around the ink circuit in the reverse direction.

3. A continuous ink jet printer according to claim 2 in which the suction source comprises at least one Venturi device in the ink return path between the ink tank and a point in the ink return path where the ink feed path leaves the ink return path.

4. A continuous ink jet printer according to claim 1 in which there are at least four said ink inlet openings spaced from each other across the ink tank.

5. A continuous ink jet printer according to claim 1 in which in which there are at least eight said ink inlet openings.

6. A continuous ink jet printer according to claim 1 in which the ink pump arrangement comprises a reversible ink pump.

7. A continuous ink jet printer according to claim 1 in which the ink inlet openings are at the bottom of the ink tank and face at least partially towards the floor of the ink tank or face parallel to the floor of the ink tank.

8. A continuous ink jet printer according to claim 1 in which ink supply path includes an ink filter inside the ink tank and the ink inlet openings are provided in a wall that surrounds the ink filter.

9. A continuous ink jet printer according to claim 1 in which the floor of the ink tank is flat over substantially the entire area of the ink tank.

10. A method of operating a continuous ink jet printer, the printer comprising an ink circuit, the ink circuit comprising an ink tank, an ink pump arrangement, an ink supply path from one or more ink inlet openings inside the ink tank to the ink pump arrangement and an ink return path from the ink pump arrangement to the interior of the ink tank, the method comprising:

(a) a forward flow step in which the ink pump arrangement is used to pump ink around the ink circuit in a forward direction such that ink flows from the interior of the ink tank through the one or more ink inlet openings and along the ink supply path to the ink pump arrangement, and from the ink pump arrangement along the ink return path back to the interior of the ink tank; and (b) a reverse flow step in which the ink pump arrangement is used to pump fluid around the ink circuit in a reverse direction such that fluid flows from the interior of the ink tank to the ink pump arrangement along the ink return path, and from the ink pump arrangement back to the interior of the ink tank along the ink supply path and through the one or more ink inlet openings.

11. A method according to claim 10 in which the fluid entering the return path from the interior of the ink tank in the reverse flow step is a gas.

12. A method according to claim 11 in which the reverse flow step is performed for sufficiently long that, if the ink circuit is full of ink at the beginning of the reverse flow step, gas flows along the length of the ink circuit and back to the interior of the ink tank before the reverse flow step is terminated.

13. A method according to claim 10 in which the forward flow step is performed in a jet forming operation, the jet forming operation further comprising conveying ink from the ink return path to an ink gun of the continuous ink jet printer to form an ink jet during the forward flow step, and catching ink from the ink jet that is not used for printing and returning it to the interior of the ink tank, and the reverse flow step is performed in an ink mixing operation.

14. A method according to claim 13 in which the forward flow step is also performed in the ink mixing operation.

15. A method according to claim 14 in which the forward flow step is performed in the ink mixing operation without conveying ink from the ink return path to the ink gun at any time during the forward flow step.

16. A method according to claim 14 in which the ink mixing operation comprises one or more mix cycles in which the forward flow step is followed by the reverse flow step.

17. A method according to claim 16 in which, during at least one mix cycle, the forward flow step is performed for sufficiently long that, if the ink circuit is substantially empty of ink at the beginning of the forward flow step ink, ink flows along the length of the ink circuit and back to the interior of the ink tank before the forward flow step is terminated.

18. A method according to claim 16 in which, on at least some occasions when the printer is restarted after a period of being idle, the ink mixing operation is performed before the jet forming operation is performed and the number of mix cycles performed in the mixing operation depends on the length of time that the printer has been idle.

19. A method according to claim 10 in which the ink velocity through at least some of the inlet openings reaches at least 0.1 $ms^{-1}$ during the reverse flow step.

20. A method according to claim 10 in which the ink velocity through at least some of the inlet openings reaches at least 0.3 $ms^{-1}$ during the reverse flow step.

* * * * *